US010142760B1

(12) United States Patent
Richman et al.

(10) Patent No.: US 10,142,760 B1
(45) Date of Patent: Nov. 27, 2018

(54) AUDIO PROCESSING MECHANISM WITH PERSONALIZED FREQUENCY RESPONSE FILTER AND PERSONALIZED HEAD-RELATED TRANSFER FUNCTION (HRTF)

(71) Applicant: Sony Corporation, Tokyo (JP)

(72) Inventors: Steven Martin Richman, San Diego, CA (US); Gregory Peter Carlsson, Santee, CA (US)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/920,710

(22) Filed: Mar. 14, 2018

(51) Int. Cl.
*H04R 5/02* (2006.01)
*H04S 7/00* (2006.01)

(52) U.S. Cl.
CPC ..... *H04S 7/303* (2013.01); *H04S 2420/01* (2013.01)

(58) Field of Classification Search
CPC ..... H04S 7/303; H04S 2420/01
See application file for complete search history.

(56) References Cited

U.S. PATENT DOCUMENTS

| | | | | |
|---|---|---|---|---|
| 7,634,092 | B2 | 12/2009 | McGrath | |
| 7,720,229 | B2 | 5/2010 | Duraiswami et al. | |
| 8,503,682 | B2 | 8/2013 | Fukui et al. | |
| 8,520,857 | B2 | 8/2013 | Fukui et al. | |
| 8,787,584 | B2 | 7/2014 | Nyström et al. | |
| 9,118,991 | B2 | 8/2015 | Nystrom et al. | |
| 9,448,405 | B2 | 9/2016 | Yamamoto | |
| 9,740,305 | B2 | 8/2017 | Kabasawa et al. | |
| 9,930,468 | B2 * | 3/2018 | Christoph | H04S 7/302 |
| 2016/0044430 | A1 * | 2/2016 | McGrath | H04S 1/005 381/17 |
| 2016/0269849 | A1 | 9/2016 | Riggs et al. | |
| 2017/0332186 | A1 | 11/2017 | Riggs et al. | |

FOREIGN PATENT DOCUMENTS

| | | | |
|---|---|---|---|
| JP | 5285626 | B2 | 9/2013 |
| JP | 2017092732 | A | 5/2017 |

OTHER PUBLICATIONS

"Hear an Entirely New Dimension of Sound", OSSIC, Retrieved on Oct. 10, 2017 from https://www.ossic.com/3d-audio/.
Henrik Moller, "Fundamentals of Binaural Technology", Acoustics Laboratory, Aalborg University, Mar. 3, 1992, Aalborg, Denmark.
Sylvia Sima, "HRTF Measurements and Filter Design for a Headphone-Based 3D-Audio System", Faculty of Engineering and Computer Science, Department of Computer Science, University of Applied Sciences, Hamburg, Germany, Sep. 6, 2008.
James R. Milne, Gregory Peter Carlsson, "Personalized End User Head-Related Transfer Function (HRTV) Finite Impulse Response (FIR) Filter", file history of related U.S. Appl. No. 15/822,473, filed Nov. 27, 2017.

* cited by examiner

*Primary Examiner* — Andrew L Sniezek
(74) *Attorney, Agent, or Firm* — John L. Rogitz

(57) ABSTRACT

Left and right ear channels are determined for an end user. Each channel includes a head related transfer function (HRTF) filter to localize sound tailored to the geometry of the user's head and a frequency response filter tailored to the user's measured frequency response (hearing capability).

17 Claims, 8 Drawing Sheets

AUDIO PROCESSING MECHANISM WITH PERSONALIZED FREQUENCY RESPONSE FILTER AND PERSONALIZED HEAD-RELATED TRANSFER FUNCTION (HRTF)

FIELD

The present application relates generally to audio processing mechanisms with personalized frequency response filters and personalized head-related transfer function (HRTF) filters.

BACKGROUND

Equalizers are used for modifying the amplitude of sound frequencies based on a listener's preferences but are not capable of being manipulated to discriminate individual sounds. As understood herein, combining frequency amplitude adjustment (to compensate for hearing impairment) with customized HRTF can be used to deliver superior sound clarity and localization for individuals who seek to experience great sound immersion, and also can be used for individuals who have hearing aids or minor hearing impairments to distinguish sounds better without modifying the spectrum of audible frequencies.

Manufacturers of hearing aids traditionally have simply modified the amplitude of all the waveforms in a collection or spectrum of sounds. This is acceptable for generalized hearing loss, but it introduces noise as well, which can make it hard to distinguish sounds as the waveforms are amplified. A much larger group of people can hear well in a quiet environment, but have trouble listening to and understanding conversations in noisy environments. These people typically suffer from partial hearing loss or find it hard to distinguish foreground sounds from background sounds.

SUMMARY

Present principles are directed to providing an audio processing mechanism including a unique Head Related Transfer Function (HRTF) filter and a personalized frequency response filter for a set of headphones for a specific listener by employing object-based audio technology to adjust sound characteristics that conform to the listener's hearing capability. The sound compensation algorithm may be derived by using a Discrete Fourier Transform (DFT) or a Fast Fourier Transform (FFT) method for binning sound frequencies (spectrum of waveforms) that are then reduced to sound field objects. Each object created is based on a set of frequencies often referred to as a pitch range or unique acoustical sensation to the listener's ear. Each DFT or FFT bin reflects or captures an audio frequency range with related characteristics, such as the timbre of a person's voice or the location of an instrument being played or directionality of a background sound such as a plane flying overhead. The sound object can then be adjusted in its base sound elements to allow for a headphone listener to more accurately hear or discern sounds with more clarity and less distortion. The personalized sound experience is thus customized to the way each listener hears sound. Each object is adjusted for a personal listener based on that user's ear structure, hearing capabilities and impairments. The total soundstage of objects for a song or movie or TV show can be acoustically blended together and directionally positioned based on a personal audio processing mechanism.

The end result is a personalized sound experience by a set of headphones that takes into account the actual listeners hearing modalities.

The use of FFT and DFTs to isolate bins of sound that represent discrete sound objects in nature is one preferred method for object-based audio. These bins can be analyzed and characterized based on their sound elements to identify their location, directionality, sinusoidal waveform and distribution. Vocals can be distinguished from instruments as are static objects distinguished from moving objects. This characterization of sound can be determined based on analyzing the DFT or FFT bins that are digital slices of frequencies or waveforms in a time-based sampling. Also employing customized HRTFs that then utilize frequency filters that are based upon the listener who identifies direct impairments using a calibration model to derive the listener's sound profile.

Accordingly, in an aspect, a system includes at least a left audio channel input and a left channel impulse response (IR) filter configured for receiving audio data from the left channel audio input. The left channel IR filter has taps established at least in part by a frequency response profile for a left ear of a listener. A left channel head related transfer function (HRTF) filter includes taps established at least in part by a physical characteristic of the listener. The left channel HRTF is for receiving audio data from the left channel audio input and is in series with the left channel IR filter to send signals to or receive signals from the left channel IR filter. A left channel speaker is configured for receiving signals that have passed through the left channel IR filter and left channel HRTF filter for transducing the signals into sound.

At least a right audio channel input is also provided, and a right channel IR filter is configured for receiving audio data from the right channel audio input. The right channel IR filter has taps established at least in part by a frequency response profile for a right ear of the listener. A right channel HRTF filter includes taps established at least in part by a physical characteristic of the listener and is configured for receiving audio data from the right channel audio input. The right channel HRTF filter is in series with right left channel IR filter to send signals to or receive signals from the right channel IR filter. A right channel speaker is configured for receiving signals that have passed through the right channel IR filter and right channel HRTF filter for transducing the signals into sound.

The left channel IR filter may be a finite IR filter. The left channel IR filter can be an infinite IR filter. Likewise, the right channel IR filter may be a FIR or an IIR filter.

In some examples, the left channel HRTF filter sends signals to the left channel IR filter (i.e., is upstream of the left channel IR filter). In other examples, the left channel HRTF filter receives signals from the left channel IR filter (i.e., is downstream from the left channel IR filter). The right channel may be similarly configured.

In example embodiments, at least a left microphone and at least a right microphone are provided, and the left channel IR is configured for receiving signals from the left microphone while the right channel IR is configured for receiving signals from the right microphone. In this way, noise cancellation or noise augmentation may be effected.

In example embodiments, at least one computer medium that is not a transitory signal includes instructions executable by at least one processor to access at least a first set of HRTFs tailored to the listener, with each HRTF being associated with an orientation of the listener's head. The instructions are executable to identify an orientation of the listener's head, and to identify a first one of the first set of HRTF based at least in part on the identification of the orientation of the listener's head. The instructions are further executable to convolute an audio stream using the first one of the first set of HRTF to render an adjusted stream and play the adjusted stream on at least the left speaker. If desired, the instructions may be executable to concatenate the first one of the first set of HRTF with a HRTF associated with a space to render a concatenated HRTF. The instructions can be executable to convolute the audio stream using the concatenated HRTF to render the adjusted stream, and to play the adjusted stream on at least the left speaker.

In another aspect, a method includes generating a left ear frequency response profile for a specific listener and generating a right ear frequency response profile for the specific listener. The method includes grouping frequencies in objects in each profile such that each object represents a group of respective frequencies. Further, the method includes establishing the taps of respective left and right impulse response (IR) filters using the objects, passing signals through the IR filters to render filtered signals, and playing the filtered signals on respective left and right speakers.

In another aspect, an assembly includes at least a left audio channel input and a left channel impulse response (IR) filter configured for receiving audio data from the left channel audio input. The left channel IR filter has taps established at least in part by an audio object-based frequency response profile for a left ear of a listener. A left channel speaker is configured for receiving signals that have passed through the left channel IR filter for transducing the signals into sound. At least a right audio channel input is also provided, and a right channel IR filter is configured for receiving audio data from the right channel audio input. The right channel IR filter has taps established at least in part by an audio object-based frequency response profile for a right ear of the listener. A right channel speaker is configured for receiving signals that have passed through the right channel IR filter for transducing the signals into sound.

The details of the present application, both as to its structure and operation, can be best understood in reference to the accompanying drawings, in which like reference numerals refer to like parts, and in which:

DETAILED DESCRIPTION

Figure 9:
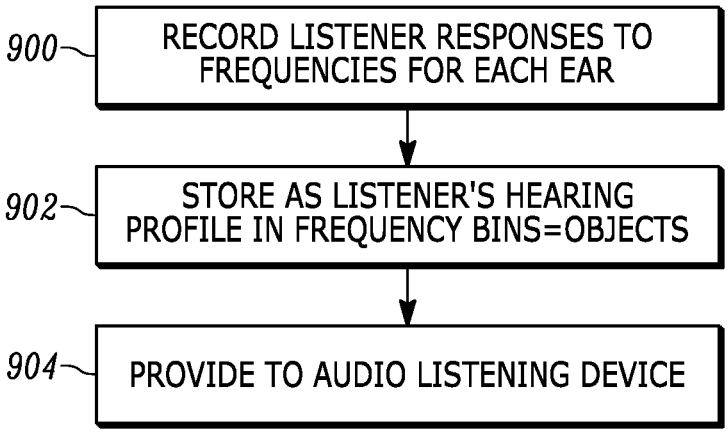
FIG. 9 is a flow chart of example logic for generating a listener's frequency response profile.
Figure 10:
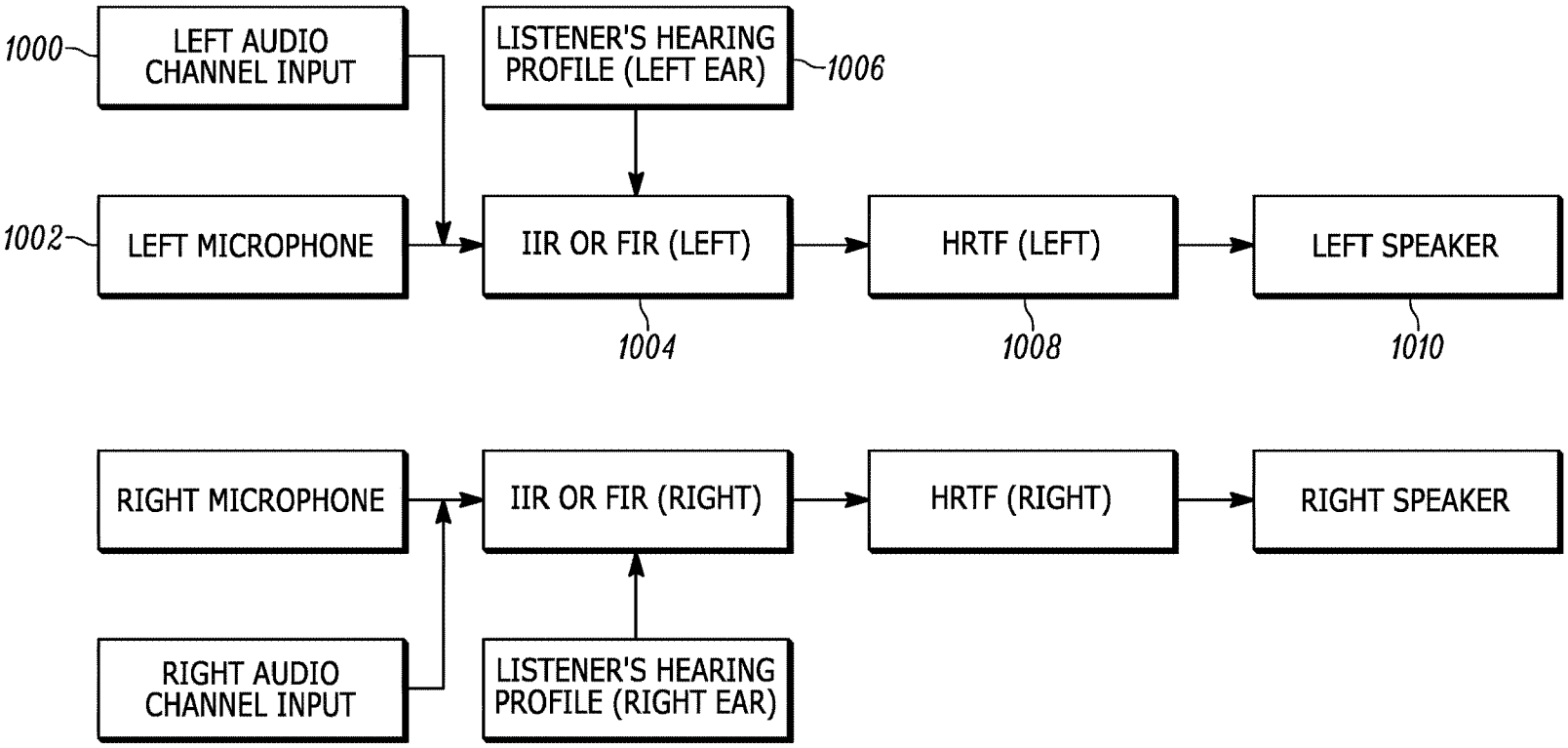
FIG. 10 is a block diagram of an example audio processing mechanism with personalized frequency response filter and personalized HRTF.

Both a personalized frequency response filter in combination with a personalized HRTF are provided herein. FIGS. 1-8 focus on deriving the HRTF, while FIGS. 9 and 10 illustrate combining the HRTF with the frequency response filters.

In overview, HRTF calibration is rendered relatively main stream by, in one embodiment, creating a HRTF calibration file using a pair of headphones that have special-purpose built-in microphones. The calibration file stores the FIR coefficients. Some of the microphones can be located inside the headphones, some inside the ears, and some outside the headphones. The headphones are connected to a sound source via the microphones. The sound source then generates key calibration sounds that are recorded by the microphones and stored digitally on a personal computer or other smart device. In some implementations the sound source material is generated by a particular sound system (2-channel or multi-channel) that exists outside the headphones. Internal (relative to the headphones) calibration signals may be used to aid the process as well.

Several different calibration files may be created. For example, a calibration file can be created for two-channel sound, another for more than two-channel sound ("multi-channel sound"), and another to aid in up-rendering two-channel sound to multi-channel sound. With these different types of portable calibration files, an end user can implement his personalized HRTF on any audio processing to generate a particular three-dimensional (3D) sound experience that produces the sense on the part of the user that the sound is not emanating from, e.g., headphone speakers by the ears, but rather from sources such as speakers or an orchestra outside the headphones. This creates a 3-D sound experience and may include height and head tracking such that perceived sound sources remain in their pre-determined locations even when the head is moving around.

As mentioned above, the calibration file can include an FIR filter or filters that can be implemented on a digital signal processor (DSP) or general-purpose processor such as and ARM core. The complexity or number of taps needed to accurately model the user's HRTF may be determined by the application using the calibration files to filter sound on the user's playback device. The user may also be given the opportunity to select the number of taps, within a given range.

With these principles, an end user consumer can own his own pair of special headphones and applications and create the calibration files. The calibration files may be created on a system at a local retail outlet for a fee if desired or complimentary with a purchase, and then consumer takes the file home.

Present principles may be extended to equipment, such as stereo playback on speakers, multi-channel playback, multi-channel playback created from stereo, or future equipment and setups.

This disclosure accordingly relates generally to computer ecosystems including aspects of multiple audio speaker ecosystems. A system herein may include server and client components, connected over a network such that data may be exchanged between the client and server components. The client components may include one or more computing devices that have audio speakers including audio speaker assemblies per se but also including speaker-bearing devices such as portable televisions (e.g. smart TVs, Internet-enabled TVs), portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers may include one or more processors executing instructions that configure the servers to receive and transmit data over a network such as the Internet. Or, a client and server can be connected over a local intranet or a virtual private network.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be any conventional general-purpose single- or multi-chip processor that can execute logic by means of various lines such as address lines, data lines, and control lines and registers and shift registers. A processor may be implemented by a digital signal processor (DSP), for example.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general-purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optic and coaxial wires and digital subscriber line (DSL) and twisted pair wires.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example system 10 is shown, which may include one or more of the example devices mentioned above and described further below in accordance with present principles. The first of the example devices included in the system 10 is an example consumer electronics (CE) device 12. The CE device 12 may be, e.g., a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, etc., and even e.g. a computerized Internet-enabled television (TV). Regardless, it is to be understood that the CE device 12 is an example of a device that may be configured to undertake present principles (e.g. communicate with other devices to undertake present principles, execute the logic described herein, and perform any other functions and/or operations described herein).

Figure 1:
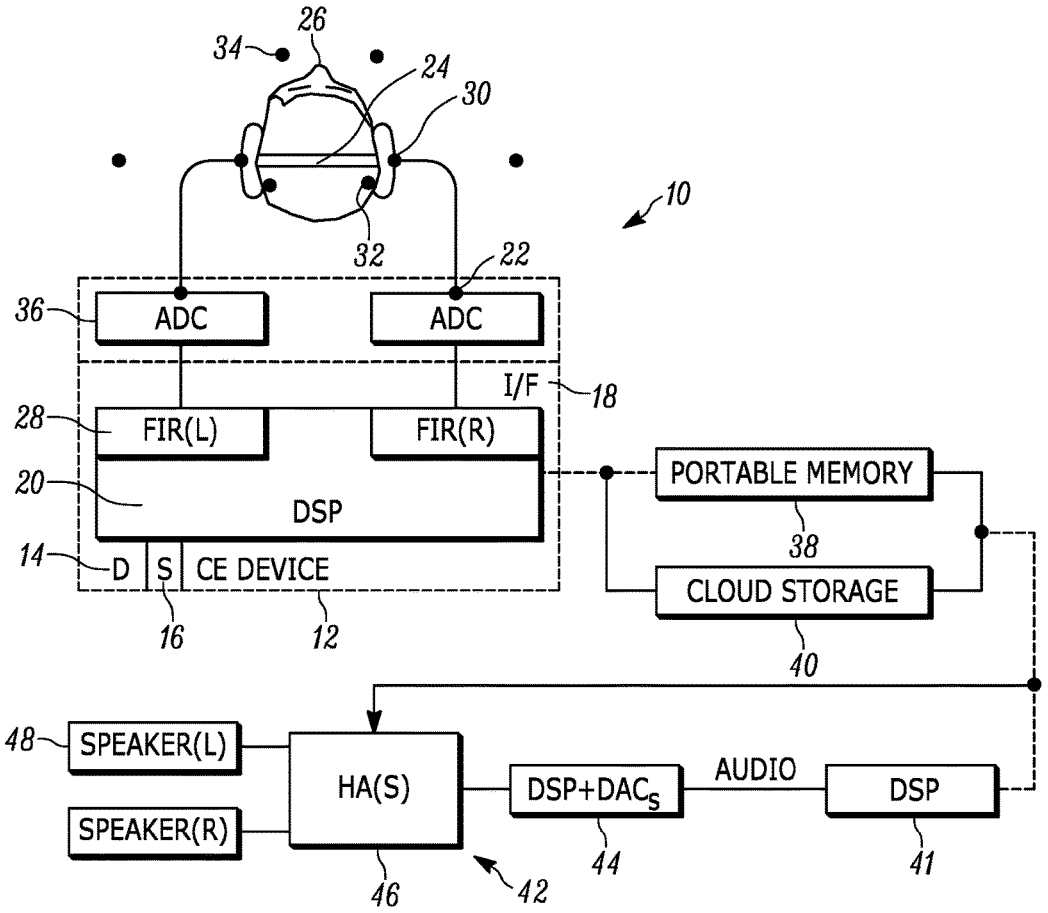
FIG. 1 is a block diagram of an example HRTF recording and playback system.

Accordingly, to undertake such principles the CE device 12 can be established by some or all of the components shown in FIG. 1. For example, the CE device 12 can include one or more touch-enabled displays 14, and one or more speakers 16 for outputting audio in accordance with present principles. The example CE device 12 may also include one or more network interfaces 18 for communication over at least one network such as the Internet, a WAN, a LAN, etc. under control of one or more processors 20 such as but not limited to a DSP. It is to be understood that the processor 20 controls the CE device 12 to undertake present principles, including the other elements of the CE device 12 described herein. Furthermore, note the network interface 18 may be, e.g., a wired or wireless modem or router, or other appropriate interface such as, e.g., a wireless telephony transceiver, Wi-Fi transceiver, etc.

In addition to the foregoing, the CE device 12 may also include one or more input ports 22 such as, e.g., a USB port to physically connect (e.g. using a wired connection) to another CE device and/or a headphone 24 that can be worn by a person 26. The CE device 12 may further include one or more computer memories 28 such as disk-based or solid-state storage that are not transitory signals on which is stored files such as the below-described HRTF calibration files. The CE device 12 may receive, via the ports 22 or wireless links via the interface 18 signals from first microphones 30 in the earpiece of the headphones 24, second microphones 32 in the ears of the person 26, and third microphones 34 external to the headphones and person, although only the headphone microphones may be provided in some embodiments. The signals from the microphones 30, 32, 34 may be digitized by one or more analog to digital converters (ADC) 36, which may be implemented by the CE device 12 as shown or externally to the CE device.

As described further below, the signals from the microphones can be used to generate HRTF calibration files that are personalized to the person 26 wearing the calibration headphones. A HRTF calibration file typically includes at least one and more typically left ear and right ear FIR filters, each of which typically includes multiple taps, with each tap being associated with a respective coefficient. By convoluting an audio stream with a FIR filter, a modified audio stream is produced which is perceived by a listener to come not from, e.g., headphone speakers adjacent the ears of the listener but rather from relatively afar, as sound would come from an orchestra for example on a stage that the listener is in front of.

To enable end users to access their personalized HRTF files, the files, once generated, may be stored on a portable memory 38 and/or cloud storage 40 (typically separate devices from the CE device 12 in communication therewith, as indicated by the dashed line), with the person 26 being given the portable memory 38 or access to the cloud storage 40 so as to be able to load (as indicated by the dashed line) his personalized HRTF into a receiver such as a digital signal processor (DSP) 41 of playback device 42 of the end user. A playback device may include one or more additional processors such as a second digital signal processor (DSP) with digital to analog converters (DACs) 44 that digitize audio streams such as stereo audio or multi-channel (greater than two track) audio, convoluting the audio with the HRTF information on the memory 38 or downloaded from cloud storage. This may occur in one or more headphone amplifiers 46 which output audio to at least two speakers 48, which may be speakers of the headphones 24 that were used to generate the HRTF files from the test tones. U.S. Pat. No. 8,503,682, owned by the present assignee and incorporated herein by reference, describes a method for convoluting HRTF onto audio signals. Note that the second DSP can implement the FIR filters that are originally established by the DSP 20 of the CE device 12, which may be the same DSP used for playback or a different DSP as shown in the example of FIG. 1. Note further that the playback device 42 may or may not be a CE device.

In some implementations, HRTF files may be generated by applying a finite element method (FEM), finite difference method (FDM), finite volume method, and/or another numerical method, using 3D models to set boundary conditions.

Figure 2:
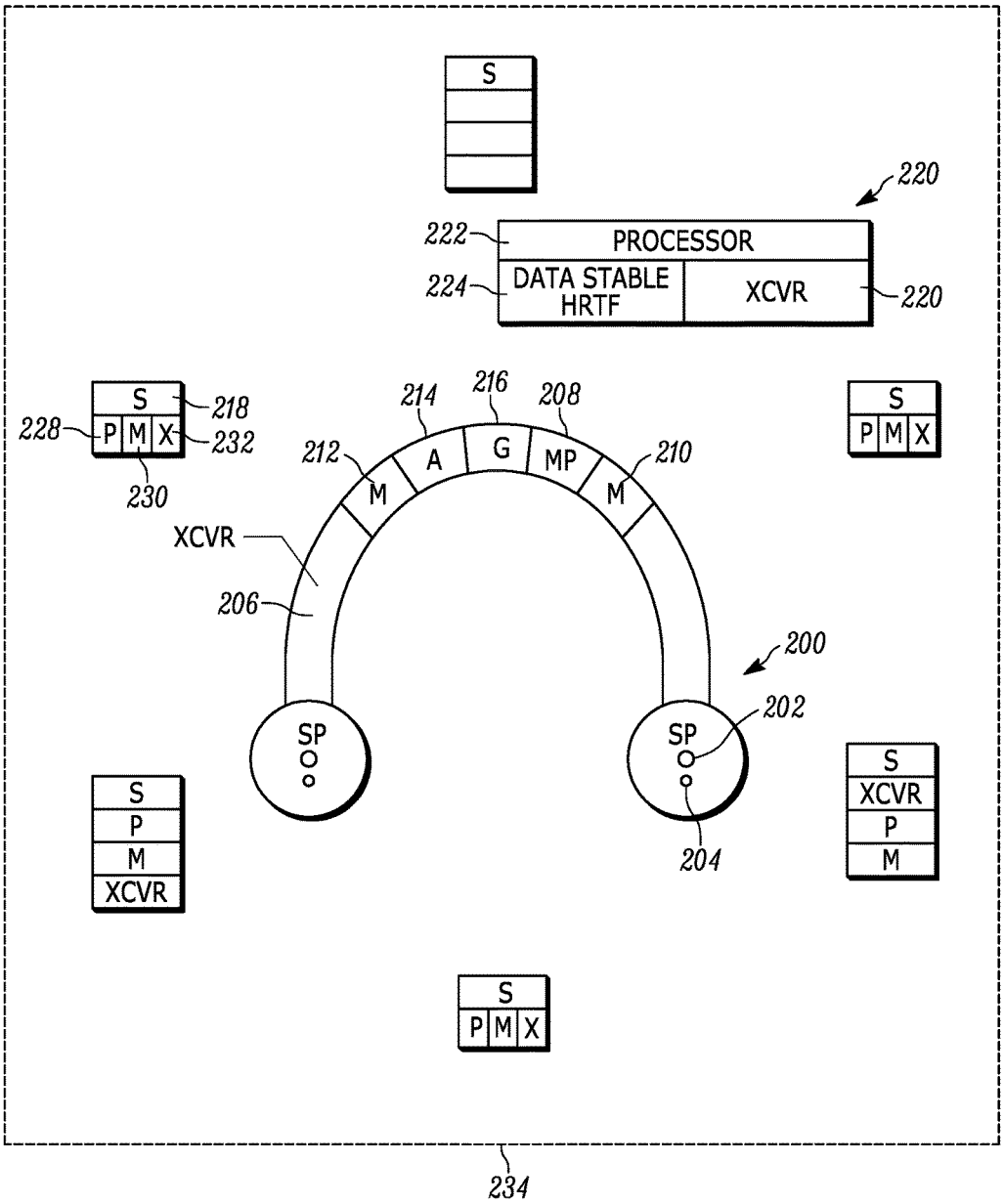
FIGS. 2 and 3 are block diagrams of example HRTF recording systems.
Figure 3:
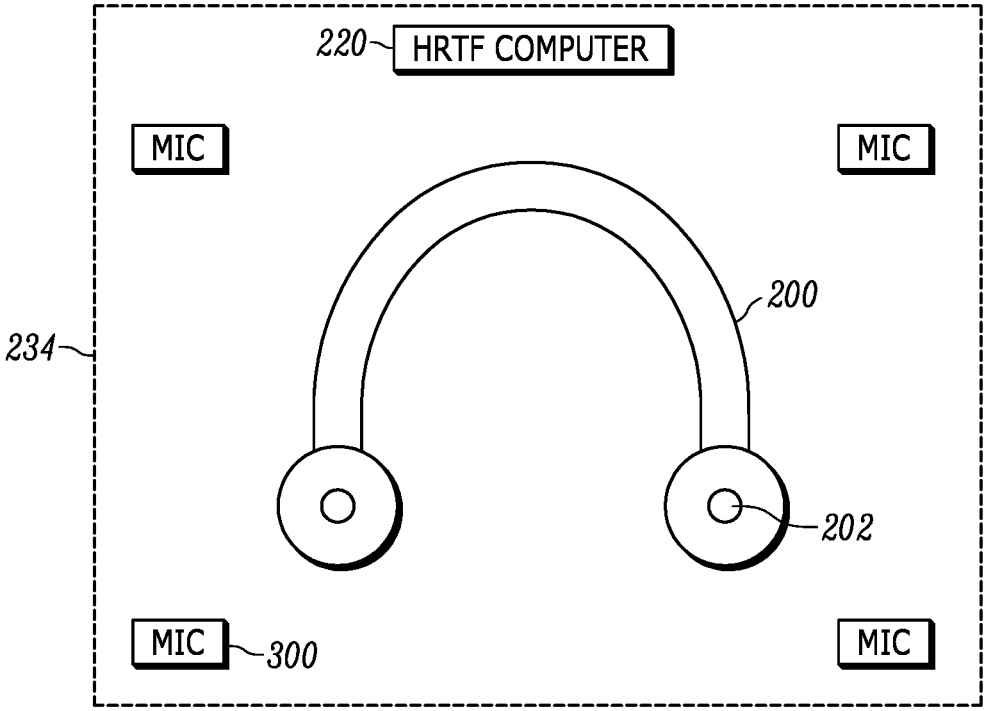

FIGS. 2 and 3 show respective HRTF file generation systems. In FIG. 2, a person (not shown) may wear headphones 200 with left and right earphone speakers 202. In lieu of or adjacent to each speaker 202 may be a respective microphone 204 for playing HRTF calibration test tones.

In the example shown, the headphones 200 may include one or more wireless transceivers 206 communicating with one or more processors 208 accessing one or more computer storage media 210. The headphones 200 may also include one or more motions sensors communicating with the processor. In the example shown, the headphones 200 include at least one magnetometer 212, at least one accelerometer 214, and at least one gyroscope 216 to establish a nine-axis motion sensor that generates signals representing orientation of the head of the wearer of the headphones 200. U.S. Pat. Nos. 9,448,405 and 9,740,305, owned by the present assignee and incorporated herein by reference, describes a nine-axis orientation measuring system in a head-mounted apparatus.

While all nine axes may be used to determine a head orientation for purposes to be shortly disclosed, in some embodiments, recognizing that sound varies the most as a person moves his head in the horizontal plane, motion in the vertical dimension (and concomitant sensor therefor) may be eliminated for simplicity.

In the example of FIG. 2, test tones from one or more speakers 218 may be played and picked up by the microphones 204, and signals from the microphones 204 may be sent via the transceiver 206 or through a wired connection to a HRTF generation computer 220, which typically includes a processor 222, computer storage 224, and communication interface 226, as well as other appropriate computers such as any described herein. Also, each speaker 218 may include a speaker processor 228 accessing speaker computer storage 230 and communicating via wired or wireless links with the computer 220 via a communication interface 232. In the example shown, test tones or other test sounds are generated by plural speakers surrounding the headphones 200 within a space 234. The space 234 may be a room of the end user's dwelling, with HRTF files being generated for each room and then the HRTF file corresponding to a room in which the end user wishes to listen to audio being selected. Or, the space 234 may be an anechoic-coated or other special sound recording room. Yet again, to generate the venue-specific HRTF described below that is independent of a person and later concatenated with a person's HRTF, the space 234 may be the venue itself, e.g., Carnegie Hall. Sadler's Wells, Old Vic, the Bolshoi theater, etc. U.S. Pat. No. 8,787,584, owned by the present assignee and incorporated herein by reference, describes a method for establishing HRTF files to account for the size of a human head. U.S. Pat. No. 8,520,857, owned by the present assignee and incorporated herein by reference, describes a method for determining HRTF. This patent also describes measuring a HRTF of a space with no dummy head or human head being accounted for.

In FIG. 2, the end user wearing the headphones 200 may be asked to orient his head at a first orientation, with coefficients of a first FIR filter being determined at that orientation, and then may be asked to reorient his head at a second orientation, with coefficients of a second filter being determined at that second orientation, and so on for plural orientations. The filters together establish the HRTF file. Or, the user may be instructed to remain motionless and the speakers 218 moved to generate the first, second . . . $N^{th}$ filters. If desired, the techniques described in U.S. Pat. No. 9,118,991, owned by the present assignee and incorporated herein by reference, may be used to reduce the file size of HRTF files.

FIG. 3 illustrates an embodiment that in all essential respects is identical to that of FIG. 2, except that instead of test audio being played on external speakers and picked up on microphones in the headphones 20X), test audio is played on the speakers 202 of the headphones 200 and picked up by one or more microphones 300 that are external to the headphones 200 and in communication with the HRTF computer 220.

Figure 4:
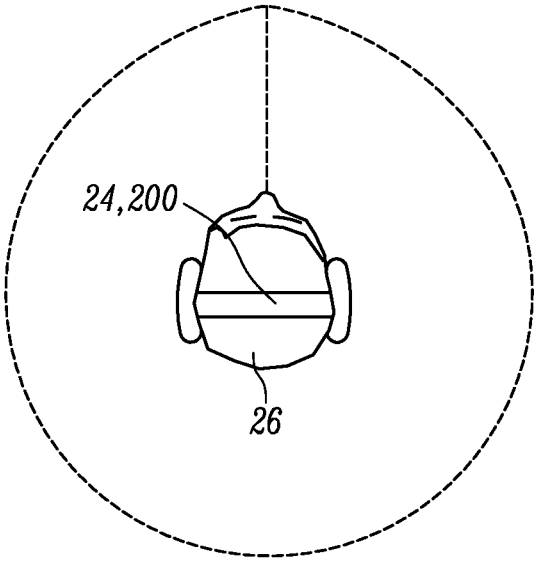
FIGS. 4 and 5 are schematic diagrams illustrating that HRTF files may be generated for plural head orientations.
Figure 5:
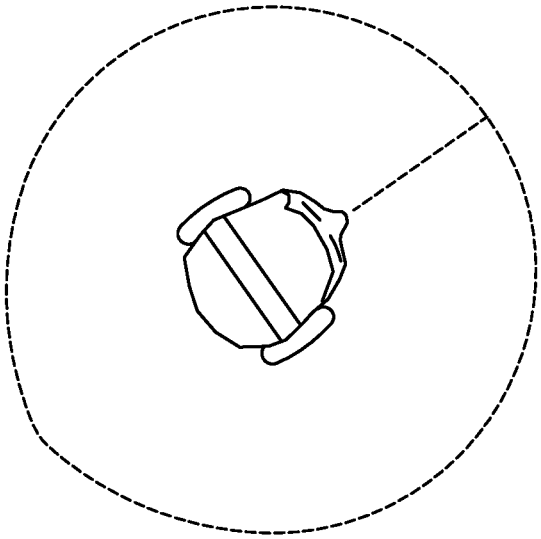

FIGS. 4 and 5 illustrate that the person 26 shown in FIG. 1 wearing the headphones 24 or 200 described previously may be instructed to orient his head in a first orientation (FIG. 4), at which a first FIR filter is generated. The first orientation may be looking straight ahead as shown. The person may then be instructed to turn his head to a second orientation (FIG. 5) at which the person is looking obliquely to straight ahead as shown, and a second FIR filter derived at the second orientation. Multiple FIR filters can be generated in this way, one for each step of orientation (e.g., one FIR filters for every two degrees of azimuth of head orientation). Note that the step of orientation may not be constant. For example, within 10 degrees of straight ahead, one filter may establish every one degree of orientation change, whereas beyond that sector, one filter may be established every three degrees of orientation.

Figure 6:
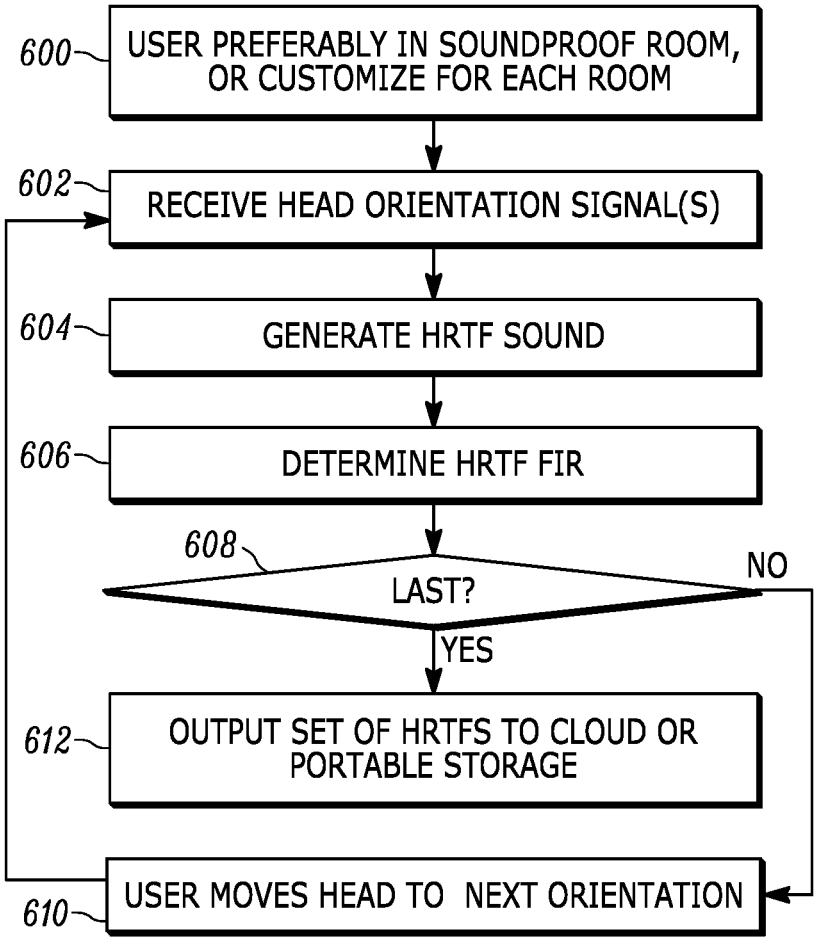
FIGS. 6 and 7 are flow charts of example HRTF recording and use logic consistent with present principles.

FIG. 6 illustrates the HRTF generation logic described above. At block 600 the user for whom the HRTF files are being personalized may be located in a sound proof room, or in a room of the user's dwelling. Proceeding to block 602, signals from the headphones indicating the orientation of the person's head are received and at that orientation HRTF test sound is generated at block 604. Based on signals from the microphones that capture the test sound, at block 606 a FIR filter is generated for the head orientation at block 602 and associated therewith in storage. If the last desired orientation to derive a FIR filter is determined to have been measured at decision diamond 608, the HRTF file (with multiple FIR filters and corresponding head orientations) is output at block 612 consistent with principles above. Otherwise, the next orientation is established at block 610 and the process loops back to block 602.

Figure 7:
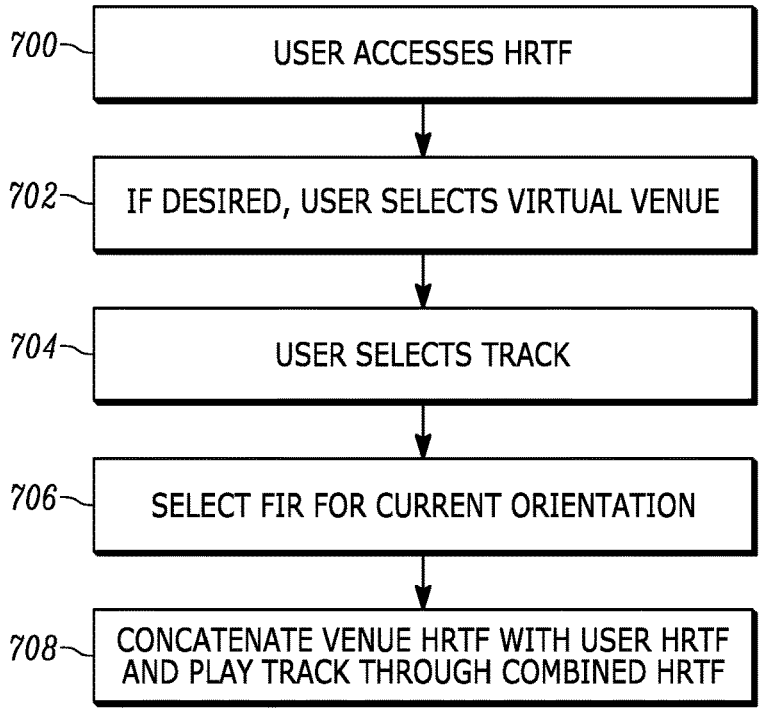

FIG. 7 illustrates example playback logic for using the personalized HRTF file(s) generated in FIG. 6. At block 700, the end user accesses his personalized HRTF. e.g., by engaging the portable media 38 with the playback device 42, by accessing cloud storage 40 and linking the HRTF files thereon to the playback device 42, etc.

Moving to block 702, if desired the user may select a virtual venue in which to simulate playing the audio track desired by the user, which is selected at block 704. Head orientation signals from the user's headphones or from another source (such as a camera imaging the user) may be received at block 706, and the corresponding FIR filter from the HRTF files selected for the sensed orientation. When a virtual venue has been selected, at block 708 it is concatenated with the user-personalized FIR filter selected at block 704 corresponding to the user's head orientation and then the concatenation is convoluted with the selected audio track and played.

Note that the logic at block 708 may not use all of the taps of the FIR filter selected at block 706. In some implementations the user may be enabled to select the number of taps to use, it being understood that the greater the number of taps, the better the fidelity but the more burdensome the processing. Or, the playback device 42 may be limited as to how many taps it can process, and therefore may automatically use only some, but not all, of the FIR taps. For example, if a FIR filter has 64 taps but the playback device can process only 32 taps, the playback device may select every other tap in the FIR filter to use, discarding the rest.

As the user may from time to time turn his head, a new orientation is sensed, and a new FIR filter selected from the HRTF file at block 706. Note that if a user's head is at an orientation that itself is not exactly correlated with a FIR filter but hat is between two orientations that are correlated with respective FIR filters, the FIR filter of the orientation closest to the actual orientation may be used. Or, the coefficients of each of "N" corresponding taps of the adjacent FIR filters may be averaged in a weighted manner and a new FIR filter generated on the fly with the averaged coefficients. For example, if the coefficient of the $N^{th}$ tap of the filter associated with the orientation immediately to the left of the user's current orientation is "A", the coefficient of the $N^{th}$ tap of the filter associated with the orientation immediately to the right of the user's current orientation is "A", and the user's current orientation is exactly midway between the filter orientations, then the coefficient of the $N^{th}$ tap of a new FIR filter generated on the fly would be (A+B)/2. If the user's current orientation is 40% of the way from the "A" orientation and thus 60% of the way from the "B" orientation, the coefficient of the $N^{th}$ tap of a new FIR filter generated on the fly would be (0.6A+0.4B).

Figure 8:
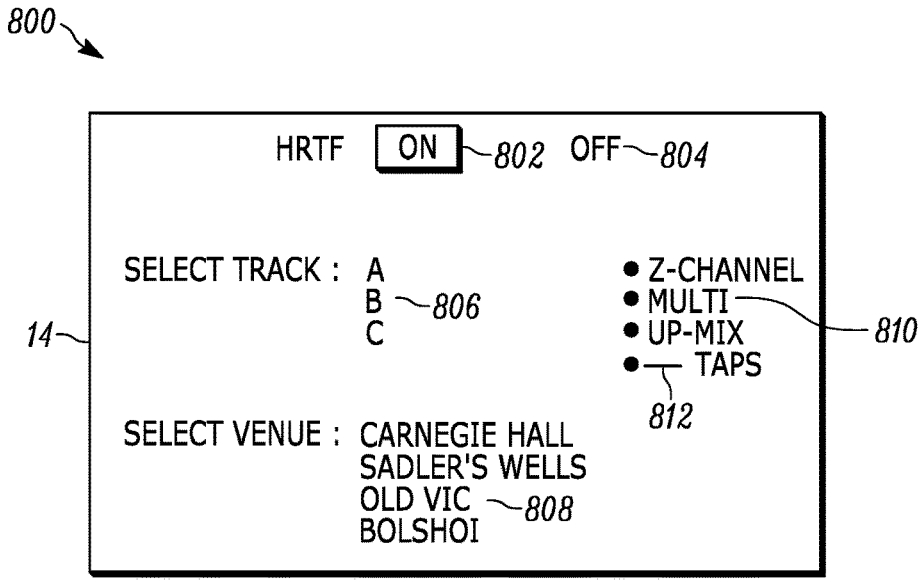
FIG. 8 is a screen shot of an example user interface (UI) consistent with present principles.

FIG. 8 illustrates a user interface (UI) 800 that may be presented on a display such as the display 14 shown in FIG. 1, consistent with present principles. The user may be given the option to turn the logic of FIG. 7 on and off by appropriately selecting on and off selectors 802, 804. If HRTF is turned on, the user may be given the option of selecting an audio track for play using a drop-down list 806 or other selector device. The user may also be given the option of selecting a venue to simulate audio track play in using a drop-down list 808 or other selector device.

If desired, the user may be given an option to select HRTF type, e.g., stereo, multi-channel, up-mix from stereo to multichannel, etc. using yet another drop-down list 810 or other selector device. In some embodiments the user may be presented with a tap selector 812 to input the number of FIR filter taps to use consistent with disclosure above.

FIG. 9 shows logic for generating a listener's frequency response profile to be used in conjunction with the HRTF principles described above. Commencing at block 900, a listener is placed in a typically acoustically isolated space with test headphones on, over which are played, in one ear at a time, a series of test frequencies, one at a time, of slowly increasing or decreasing volume. The listener is asked to indicate when he or she first hears or can no longer hear a test frequency, and the volume at which the listener indicates perception is recorded. In this way, a map is generated for each ear that correlates frequencies to volumes at which the frequencies became perceptible to the listener and stored at block 902 as the listener's hearing profile for that ear.

The taps of a personalized frequency response filter for an audio listening device such as a set of headphones may then be configured for the specific listener at block 904 by employing object-based audio technology to adjust sound characteristics that conform to the listener's hearing capability. The sound compensation algorithm may be derived by using a Discrete Fourier Transform (DFT) or a Fast Fourier Transform (FFT) method for binning the sound frequencies (spectrum of waveforms) of the listener's profile that are then reduced to sound field objects. Each object created is based on a set of frequencies often referred to as a pitch range or unique acoustical sensation to the listener's ear. Each DFT or FFT bin reflects or captures an audio frequency range with related characteristics. An audio sound object can then be adjusted in its base sound elements by passing it through a filter the taps of which are established by the profile to allow for a headphone listener to more accurately hear or discern sounds with more clarity and less distortion.

FIG. 10 is a block diagram of an example audio processing mechanism with personalized frequency response filter and personalized HRTF, it being understood that additional components including processors and storage media may be coupled to the mechanism according to principles above. The mechanism in FIG. 10 has left and right audio channels that are identical in configuration and operation, for only the left channel need by detailed.

A left audio channel input feeds audio signals to be played as audio to a series of filters. Ambient noise from a microphone 1002 on a left earphone worn by the listener may be fed into the left audio channel for noise cancellation or ambient sound augmentation as desired. In the example shown, the input 1000 is fed to an impulse response (IR) filter 1004, the taps of which are established by the left ear hearing profile derived as described in reference to FIG. 9 above. In this way, the listener's unique hearing ability is reflected in the taps of the filter 1004. The filter 1004 may be a finite IR or infinite IR filter.

In the example shown, after passing through the filter 1004, the signals representing audio pass through a left ear HRTF filter 1008 derived according to principles set forth above for the particular listener. In this way, signals exiting the HRTF filter 1008 reflect the listener's unique head structure. The signals are played on a left speaker 1010, e.g., the left speaker of headphones.

In other embodiments, instead of being downstream of the IR filter 1004, the HRTF filter 1008 may be upstream such that the output of the HRTF is fed as input to the IR filter 1004.

The filters shown in FIG. 10 may be implemented by a DSP such as the DSP 20 shown in FIG. 1 with attendant components.

While the particular embodiments are herein shown and described in detail, it is to be understood that the subject matter which is encompassed by the present invention is limited only by the claims.

What is claimed is:

1. A system comprising:

at least a left audio channel input;

a left channel impulse response (IR) filter configured for receiving audio data from the left channel audio input, the left channel IR filter comprising taps established at least in part by a frequency response profile for a left ear of a listener;

a left channel head related transfer function (HRTF) filter comprising taps established at least in part by a physical characteristic of the listener and configured for receiving audio data from the left channel audio input, the left channel HRTF filter being in series with the left channel IR filter to send signals to or receive signals from the left channel IR filter;

a left channel speaker configured for receiving signals that have passed through the left channel IR filter and left channel HRTF filter for transducing the signals into sound;

at least a right audio channel input;

a right channel IR filter configured for receiving audio data from the right channel audio input, the right channel IR filter comprising taps established at least in part by a frequency response profile for a right ear of the listener;

a right channel HRTF filter comprising taps established at least in part by a physical characteristic of the listener configured for receiving audio data from the right channel audio input, the right channel HRTF filter being in series with right left channel IR filter to send signals to or receive signals from the right channel IR filter; and a right channel speaker configured for receiving signals that have passed through the right channel IR filter and right channel HRTF filter for transducing the signals into sound, wherein the left channel HRTF filter receives signals from the left channel IR filter.

2. The system of claim 1, wherein the left channel IR filter is a finite IR filter.

3. The system of claim 1, wherein the left channel IR filter is an infinite IR filter.

4. The system of claim 1, wherein the left channel HRTF filter sends signals to the left channel IR filter.

5. The system of claim 1, comprising:

at least a left microphone;

at least a right microphone;

the left channel IR filter configured for receiving signals from the left microphone;

the right channel IR filter configured for receiving signals from the right microphone.

6. The system of claim 1, comprising at least one computer medium that is not a transitory signal and that comprises instructions executable by at least one processor to:

access at least a first set of HRTFs tailored to the listener, each HRTF being associated with an orientation of the listener's head;

identify an orientation of the listener's head;

identify a first one of the first set of HRTF based at least in part on the identification of the orientation of the listener's head;

convolute an audio stream using the first one of the first set of HRTF to render an adjusted stream; and play the adjusted stream on at least the left speaker.

7. A system comprising:

at least a left audio channel input;

a left channel impulse response (IR) filter configured for receiving audio data from the left channel audio input, the left channel IR filter comprising taps established at least in part by a frequency response profile for a left ear of a listener;

a left channel head related transfer function (HRTF) filter comprising taps established at least in part by a physical characteristic of the listener and configured for receiving audio data from the left channel audio input, the left channel HRTF filter being in series with the left channel IR filter to send signals to or receive signals from the left channel IR filter;

a left channel speaker configured for receiving signals that have passed through the left channel IR filter and left channel HRTF filter for transducing the signals into sound;

at least a right audio channel input;

a right channel IR filter configured for receiving audio data from the right channel audio input, the right channel IR filter comprising taps established at least in part by a frequency response profile for a right ear of the listener;

a right channel HRTF filter comprising taps established at least in part by a physical characteristic of the listener configured for receiving audio data from the right channel audio input, the right channel HRTF filter being in series with right left channel IR filter to send signals to or receive signals from the right channel IR filter;

a right channel speaker configured for receiving signals that have passed through the right channel IR filter and right channel HRTF filter for transducing the signals into sound;

at least one computer medium comprising instructions executable by at least one processor to:

access at least a first set of HRTFs tailored to the listener, each HRTF being associated with an orientation of the listener's head;

identify an orientation of the listener's head;

identify a first one of the first set of HRTF based at least in part on the identification of the orientation of the listener's head;

convolute an audio stream using the first one of the first set of HRTF to render an adjusted stream; and play the adjusted stream on at least the left speaker;

concatenate the first one of the first set of HRTF with a HRTF associated with a space to render a concatenated HRTF;

convolute the audio stream using the concatenated HRTF to render the adjusted stream; and play the adjusted stream on at least the left speaker.

8. A method, comprising:

generating a left ear frequency response profile for a specific listener;

generating a right ear frequency response profile for the specific listener;

grouping frequencies in objects in each profile such that each object represents a group of respective frequencies;

establishing the taps of respective left and right impulse response (IR) filters using the objects;

passing signals through the IR filters to render filtered signals; and playing the filtered signals on respective left and right speakers, wherein a left channel head related transfer function (HRTF) receives signals from the left channel IR filter.

9. The method of claim 8, comprising passing the signals through respective left and right head related transfer function (HRTF) filters in series with the respective left and right IR filters.

10. The method of claim 9, wherein the left channel HRTF filter sends signals to the left channel IR filter.

11. The method of claim 8, wherein the left channel IR filter is a finite IR filter.

12. The method of claim 8, wherein the left channel IR filter is an infinite IR filter.

13. An assembly comprising:

at least a left audio channel input;

a left channel impulse response (IR) filter configured for receiving audio data from the left channel audio input, the left channel IR filter comprising taps established at least in part by an audio object-based frequency response profile for a left ear of a listener;

a left channel speaker configured for receiving signals that have passed through the left channel IR filter for transducing the signals into sound;

at least a right audio channel input;

a right channel IR filter configured for receiving audio data from the right channel audio input, the right channel IR filter comprising taps established at least in part by an audio object-based frequency response profile for a right ear of the listener; and a right channel speaker configured for receiving signals that have passed through the right channel IR filter for transducing the signals into sound, wherein a left channel head related transfer function (HRTF) receives signals from the left channel IR filter.

14. The assembly of claim 13, wherein the left channel HRTF filter comprises taps established at least in part by a physical characteristic of the listener and configured for receiving audio data from the left channel audio input, the left channel HRTF filter being in series with the left channel IR filter to send signals to or receive signals from the left channel IR filter; and the assembly further comprises a right channel HRTF filter comprising taps established at least in part by a physical characteristic of the listener configured for receiving audio data from the right channel audio input, the right channel HRTF filter being in series with right left channel IR filter to send signals to or receive signals from the right channel IR filter.

15. The assembly of claim 14, wherein the left channel HRTF filter sends signals to the left channel IR filter.

16. The assembly of claim 13, wherein the left channel IR filter is a finite IR filter.

17. The assembly of claim 13, wherein the left channel IR filter is an infinite IR filter.

* * * * *